US005967372A

United States Patent [19]

Favre

[11] Patent Number: 5,967,372

[45] Date of Patent: Oct. 19, 1999

[54] BOTTLE FOR THE MEASURED DISTRIBUTION OF FLUID PRODUCTS AND PROCESS FOR ITS PRODUCTION

[75] Inventor: Bernard Favre, Chevilly Larue, France

[73] Assignee: LIR France, Chevilly Larue, France

[21] Appl. No.: 08/960,039

[22] Filed: Oct. 29, 1997

[30] Foreign Application Priority Data

Nov. 5, 1996 [FR] France ..... 96 13447

[51] Int. Cl.[6] ..... B67D 5/52

[52] U.S. Cl. ..... 222/137; 222/321.9

[58] Field of Search ..... 222/135, 136, 222/145.1, 145.5, 321.9, 137

[56] References Cited

U.S. PATENT DOCUMENTS

| | | | |
|---|---|---|---|
| 3,760,986 | 9/1973 | Castner et al. | 222/137 |
| 4,826,048 | 5/1989 | Skorka et al. | 222/137 |
| 5,119,971 | 6/1992 | Reyman | 222/129 |
| 5,363,990 | 11/1994 | Fillmore | 222/135 |
| 5,385,270 | 1/1995 | Cataneo et al. | 222/134 |
| 5,398,846 | 3/1995 | Corba et al. | 222/145 |
| 5,593,064 | 1/1997 | Meshberg | 222/39 |

FOREIGN PATENT DOCUMENTS

| | | |
|---|---|---|
| 0 379 627 | 8/1990 | European Pat. Off. . |
| 0 692 312 | 1/1996 | European Pat. Off. . |
| 0 715 899 | 6/1996 | European Pat. Off. . |
| WO 94/13258 | 6/1994 | WIPO . |

*Primary Examiner*—Andres Kashnikow
*Assistant Examiner*—Jorge Bocanegra
*Attorney, Agent, or Firm*—Young & Thompson

[57] ABSTRACT

A bottle for the metered distribution of fluid cosmetic products, comprising a reservoir (1) with two chambers (2, 3) for two products to be distributed simultaneously. Each chamber (2, 3) has a pump (8, 9) comprising an actuating rod (10, 11), at least one push button (12), provided with an outlet opening, coacting respectively with the actuating rods (10, 11). The reservoir is constituted by a hollow body (1) open at one end and comprising a separation wall (4) defining the two chambers (2, 3). A collar (5) is welded in the reservoir (1) and onto the free end of the wall (4), and is provided with two openings (6, 7) facing respectively the chambers (2, 3). The pumps (8, 9) are secured respectively in these openings (6, 7).

9 Claims, 1 Drawing Sheet

BOTTLE FOR THE MEASURED DISTRIBUTION OF FLUID PRODUCTS AND PROCESS FOR ITS PRODUCTION

CROSS REFERENCE TO RELATED APPLICATION

This application corresponds to French application 96 13447 of Nov. 5, 1996, the disclosure of which is incorporated herein by reference.

FIELD OF THE INVENTION

The present invention relates to a bottle for the measured distribution of fluid products, such as cosmetic products, of the type comprising a reservoir with two chambers for two products to be distributed simultaneously, each chamber being provided with a pump comprising an actuating rod, at least one push button, provided with an outlet opening, coacting respectively with said rod.

BACKGROUND OF THE INVENTION

Dispensing bottles of this type have been the subject of considerable development in the cosmetic industry, particularly to avoid storage of two products in a mixed condition.

There is known, for example from EP-A-427 609, a dispensing bottle of this type in which each product is enclosed in an individual receptacle, the two receptacles being enclosed in a common housing. This solution is complicated and troublesome.

There is also known (see FR-A-2 650 562, particularly page 13), a dispensing bottle comprising a reservoir with two chambers and constituted by an envelope closed by welding enclosing an intermediate partition. A head for receiving a pump is formed on the envelope, the assembly being formed by injection. The production of such a bottle is again complicated and troublesome and the appearance given by the weld is not satisfactory.

SUMMARY OF THE INVENTION

The present invention aims to overcome these drawbacks of the known dispensing bottles by providing a new bottle of simple and economical production permitting a good appearance.

To this end, the bottle according to the invention is characterized in that said reservoir with two chambers is constituted by a hollow body open at one end and comprising a separation wall providing in said body two compartments, a collar welded in said reservoir and on the free end of said separation wall, said collar being provided with two openings facing respectively the two compartments, and, the two metering pumps being secured respectively in said openings.

The bottle according to the invention comprises a reservoir of simple and economical construction, without any limitation on its appearance.

Preferably, in a manner known per se, the push button is common to the two pumps and is arranged to ensure a simultaneous ejection of the two products.

The ejection can be effectuated through two separate orifices, or, in a modification, through a common orifice.

As needed, it is possible to provide that the bottle is arranged, in the case of an active product ejected with an inert carrier, that the active product will be ejected first, so as not to create a problem at the end of use.

BRIEF DESCRIPTION OF THE DRAWINGS

The invention will be better understood from a reading of the following description, of one embodiment, referring to the accompanying drawing, whose single FIGURE is a schematic cross-sectional view, partially in elevation, of the bottle.

DETAILED DESCRIPTION OF THE INVENTION

Figure 1:
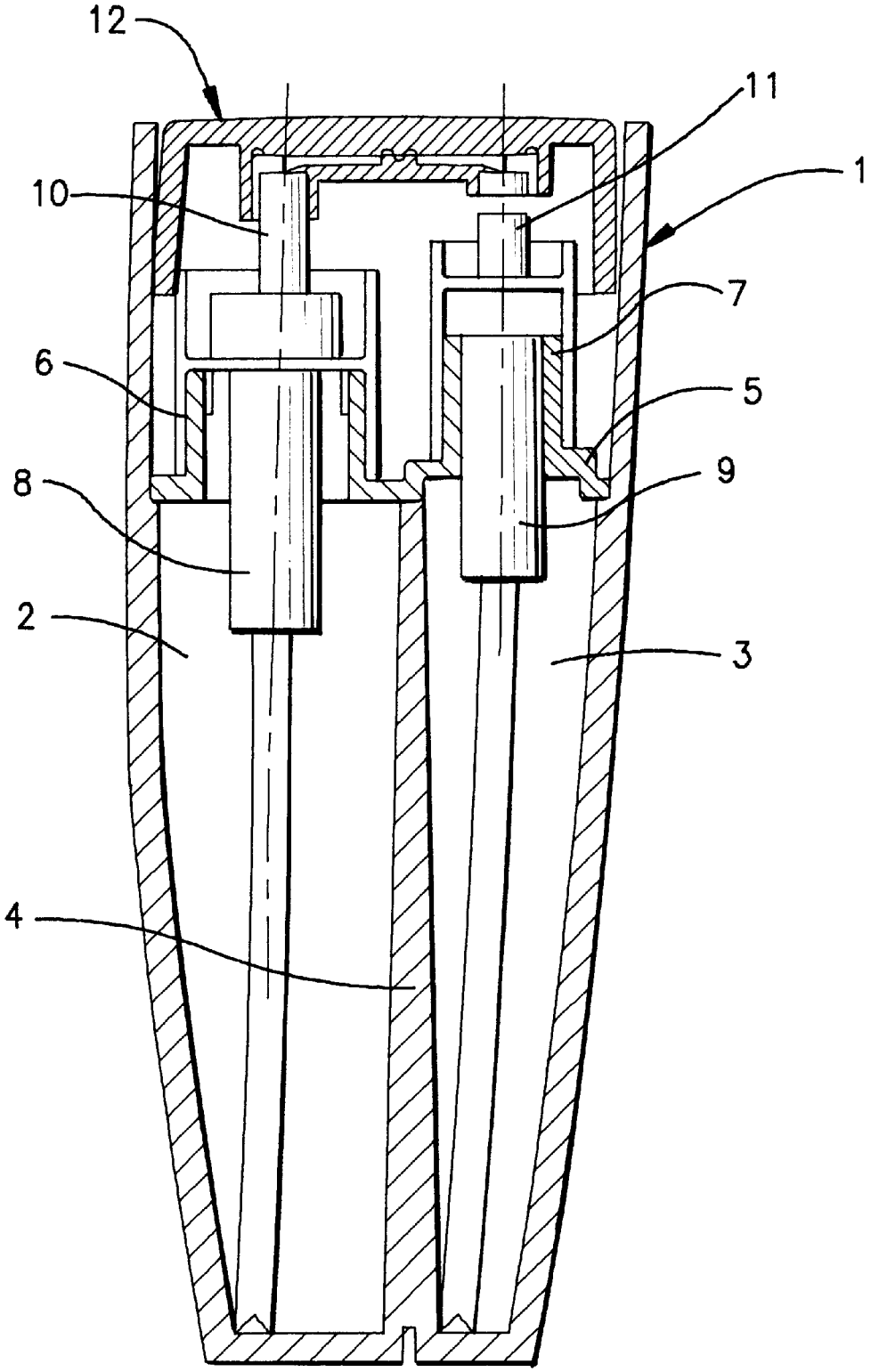

The bottle comprises a reservoir 1, open at its upper portion, divided into two compartments 2, 3 by a separation wall 4 terminating adjacent the opening of the reservoir 1. The reservoir 1 and its separation wall 4 are of a single piece of synthetic material and, given their structure, the assembly can be produced by known processes of injection, blow molding or blow extrusion.

The bottle moreover comprises a collar 5, welded in a sealed manner to the interior of the reservoir 1 and on the upper end of the wall 4. This welding can preferably be carried out by ultrasound. The collar 5 is provided with two chimneys 6, 7 facing respectively the compartments 2, 3. Pumps 8, 9 are inserted respectively in the chimneys 6, 7. Each pump 8, 9 comprises an actuating rod 10, 11 respectively and a common push button 12 is slidably mounted in the opening of the reservoir 1, on the pumps 8, 9 and comprises, in a known manner, two conduits opening into a common outlet.

The volumes of the compartments 2, 3 and the portions dispensed by the pumps 8, 9 are selected in respect to the respective contents of the products in the compartments 2, 3.

It may be advantageous that an active product, contained in one of the compartments 2 and 3, be dispensed before an inert carrier contained in the other compartment. This result can be obtained by giving the second compartment a volume slightly greater than the useful volume corresponding to the number of doses contained in the first compartment.

What is claimed is:

1. In a bottle for the metered distribution of fluid products, comprising a reservoir (1) with two chambers (2, 3) for two products to be dispensed simultaneously, each chamber (2, 3) being provided with a pump (8, 9) comprising an actuating rod (10, 11), at least one push button (12), provided with an outlet opening, coacting with said rods (10, 11); the improvement wherein said reservoir with two chambers is constituted by a hollow body (1) open at one end and comprising a separation wall (4) providing in said body (1) said two chambers (2, 3), a collar (5) welded in said reservoir (1) and on the free end of said separation wall (4), said collar (5) being provided with two openings (6, 7) facing respectively the two chambers (2, 3), and two dispensing pumps (8, 9) secured respectively in said openings (6, 7).

2. Bottle according to claim 1, wherein the push button (12) is common to the two pumps (8, 9) and is arranged to provide simultaneous ejection of the two products.

3. Bottle according to claim 2, wherein the push button (12) comprises two separate outlet openings.

4. Bottle according to claim 2, wherein the push button (12) comprises but a single outlet opening.

5. Bottle according to claim 1, wherein one of the chambers (2, 3) has a volume superior to the useful volume corresponding to the number of doses contained in the other compartment (3, 2).

6. A bottle for the metered distribution of fluid products, comprising:

a single piece vessel extending in a direction of a longitudinal axis from a closed first end to an opposite open second end, said vessel comprising an inner wall and a separation wall extending therein in said direction from said first end to a distal free end, said free end being located between said first end and said second end;

a collar comprising a first opening and a second opening each extending in said direction, said collar being welded to said inner wall and said free end;

said vessel defining (a) a first chamber formed by a first portion of said collar, said inner wall, a first side of said separation wall, and said first end; (b) a second chamber formed by a second portion of said collar, said inner wall, an opposite side of said separation wall, and said first end; and (c) a third chamber formed by said first and second portions of said collar, and said inner wall;

said first opening extending between said first chamber and said third chamber, and said second opening extending between said second chamber and said third chamber;

a first pump extending through said first opening from said first chamber to said third chamber, and comprising a first actuating rod adjacent said second end, said first pump and said first actuating rod being completely contained within said vessel;

a second pump extending through said second opening from said second chamber to said third chamber, and comprising a second actuating rod adjacent said second end, said second pump and said second actuating rod being completely contained within said vessel; and at least one push button attached to said vessel at said second end having at least one outlet opening, said push button being operatively connected to said first actuating rod and said second actuating rod; and said push button enclosing said second end.

7. The bottle according to claim 6, wherein the first chamber stores a first fluid product, and the second chamber stores a second fluid product, and actuation of the push button dispenses the first fluid product and the second fluid product simultaneously.

8. The bottle according to claim 7, wherein the push button comprises two separate outlet openings.

9. The bottle according to claim 6, wherein the first chamber has a larger volume than the second chamber.

* * * * *